United States Patent [19]

Hansen

[11] Patent Number: 4,458,818

[45] Date of Patent: Jul. 10, 1984

[54] RECLOSABLE PLASTIC CONTAINER

[76] Inventor: Gerhard Hansen, Heerstrasse 20, 7166 Sulzbach-Laufen, Fed. Rep. of Germany

[21] Appl. No.: 437,022

[22] Filed: Oct. 27, 1982

[30] Foreign Application Priority Data

Oct. 28, 1981 [DE] Fed. Rep. of Germany ..... 3142651

[51] Int. Cl.[3] ..... B65D 1/02

[52] U.S. Cl. ..... 215/32; 215/245; 222/558

[58] Field of Search ..... 215/244, 245, 32; 222/558, 517

[56] References Cited

U.S. PATENT DOCUMENTS 1,052,228 2/1913 Eder ..... 222/558
2,044,837 6/1936 Davis ..... 222/558 X
3,356,244 12/1967 Witchell ..... 215/32

FOREIGN PATENT DOCUMENTS 257339 1/1963 Australia ..... 222/558
1566102 5/1969 France ..... 215/32
181130 11/1935 Switzerland ..... 222/558

*Primary Examiner*—Donald F. Norton
*Attorney, Agent, or Firm*—Walter C. Farley

[57] ABSTRACT

A plastic container, particularly a blow-molded bottle has a container top with a discharge opening having an annular rim, and a closure body for the opening and closing of the discharge opening. For easy opening and closing, at least one bearing cup is arranged on the side of the container top. The closure body is stirrup-shaped and configured at at least one end for engagement in the bearing cup and has a closure part shaped to cooperate with the discharge opening.

6 Claims, 4 Drawing Figures

RECLOSABLE PLASTIC CONTAINER

This invention relates to a plastic container, particularly a bottle of the type which can be manufactured by conventional blow-molding processes, which has a reclosable closure member.

BACKGROUND OF THE INVENTION

Plastic containers manufactured by blow-molding processes are frequently provided with breakable closures which seal the contents of the bottle hermetically from the outside. When the breakable closure which seals in the contents has been broken off, the bottle can no longer be sealed. When such a bottle is to be reclosable after removing a portion of the contents, a threaded closure is generally used. This type of closure takes time to open and close, and the closure, generally a screw cap, is easily lost and its production cost is relatively large.

BRIEF DESCRIPTION OF THE INVENTION

An object of the present invention is to provide an easily openable and closable closure for a bottle of the type which is to be repeatedly used for dispensing its contents.

Briefly described, the invention includes a plastic container, particularly a bottle of a type which can be blow-molded, of the type having a container top with a discharge opening formed therein such that the discharge opening has an annular rim, comprising means on said container top defining a blind recess extending inwardly from the outer surface thereof, said recess being spaced from said discharge opening; and a closure member for selectively closing the discharge opening, said closure member including a generally U-shaped body having at one end a bearing member receivable and rotatable in said recess, and an closure portion spaced from said bearing member and shaped to engage and close said discharge opening.

The U-shaped or stirrup-shaped closure element which is mounted on a container top can be swiveled in a simple manner from its closed position into its open position and back again. The container, at the outset, can be configured with a discharge opening or a breakable closure closing this opening.

A particularly favorable configuration of the top of the container and the closure element results when trunion members are provided at both ends of the closure element to be received in diametrically opposite recesses in the container top. The stirrup-shaped closure element in this configuration is connected tightly in its open position and also when the container is closed.

In order that the manner in which the foregoing and other objects are attained in accordance with the convention can be understood in detail, a particular advantageous embodiment thereof will be described with reference to the accompanying drawings, which form a part of this Specification, and wherein.

Figure 1:
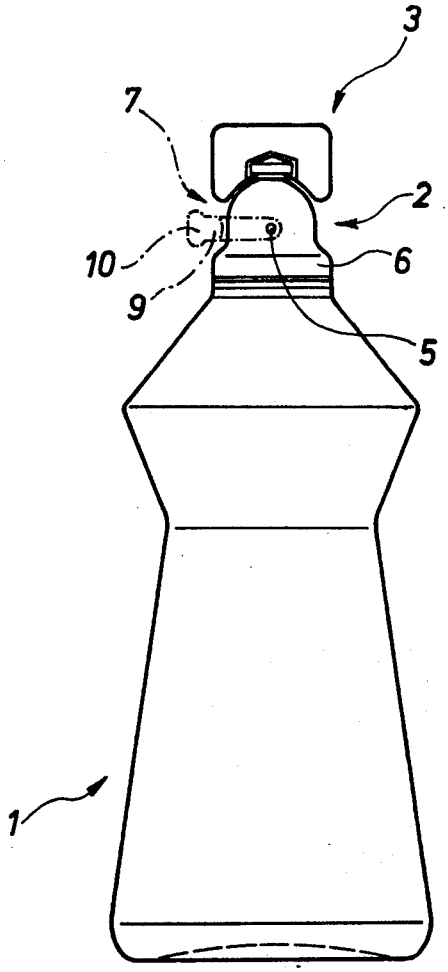
FIG. 1 is a side elevation of a container incorporating the present invention.

Referring now to the drawings in detail, the bottle 1 is manufactured in a conventional fashion by blow-molding, is filled, and its top 2 is then attached directly before the filled and closed bottle has an opportunity to change its shape or condition before closing. The container top 2 is curved and its discharge opening is closed by a breakable closure 3. The top 2 and a breakable closure 3 are so configured that when the closure 3 is broken, the discharge opening in top 2 is configured as cup or pan-shaped recess which is concave and which can be envisioned as a relatively shallow annular cup with an opening in the center thereof through which material is dispensed from the bottle.

Container top 2 is formed with means defining bearing cups 5, in the shape of blind recesses, which are located at points lying diametrically opposite each other on the top. Beneath the circle containing bearing cups 5 is provided an annular collar 6 into which fits the top portion of the bottle.

Figure 3:
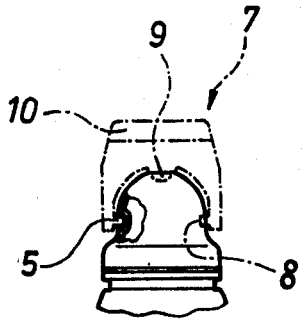
FIG. 3 is a front elevation of the container of FIGS. 1 and 2 with the frangable closure removed and the closing element swiveled to its closing position.
Figure 2:
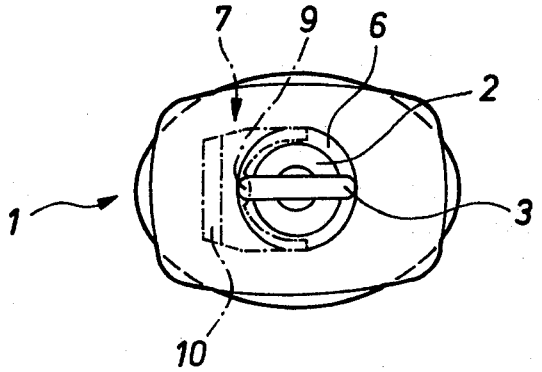
FIG. 2 is a top plan view of the container of FIG. 1.
Figure 4:
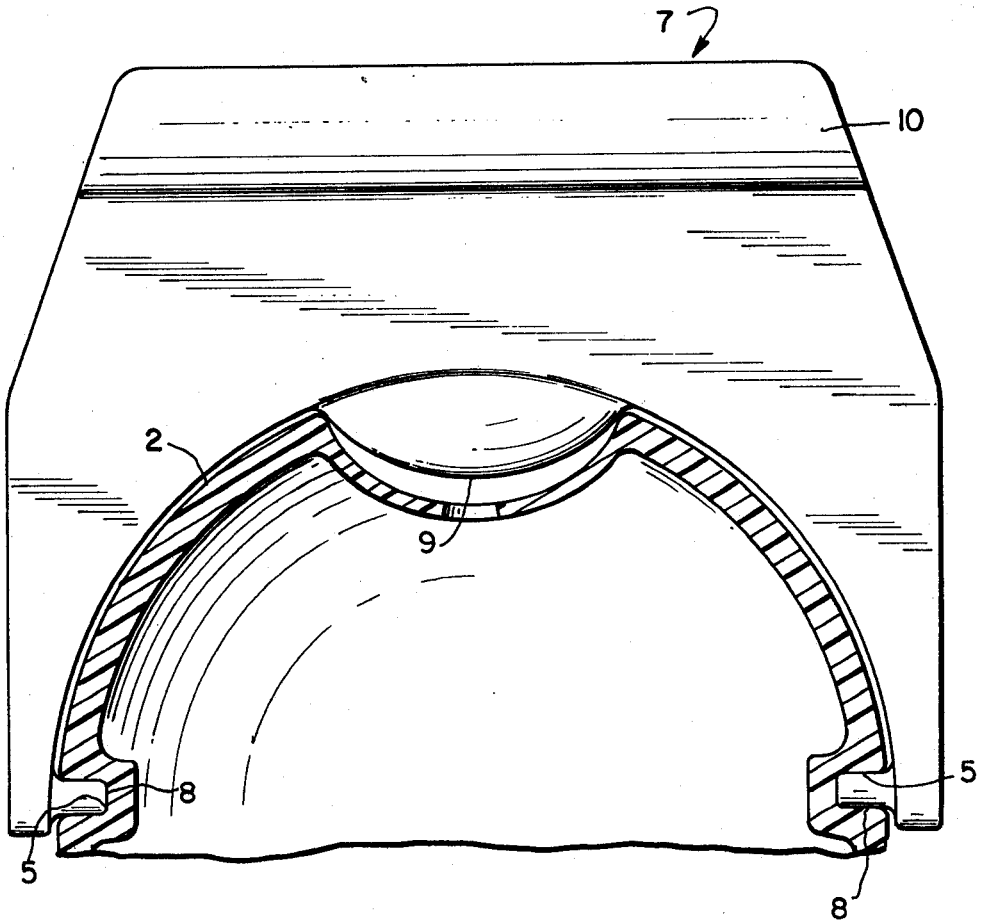
FIG. 4 is an enlarged partial front elevation of the container top with the closure element in its closing position.

A U-shaped or stirrup shaped closure body is provided to close the discharge opening of bottle 1, the closure body being shown in dash-dot lines in the figures. Closure body 7 is provided with a radially inwardly projected trunion 8 at each end thereof, each trunion being shaped to be received in one of the bearing cups 5. Closure body 7 engages, with very little play, along the periphery of top 2 and its central portion 9 is configured as a spherical or elliptical projection which, in the position shown in FIG. 3, either rests on the circular edge of the discharge opening, or on the circular edge of the discharge cup formed around the discharge opening. The discharge cup and the closure part 9 have essentially the same radii. The discharge cup can alternatively have a somewhat smaller radius than closure part 9. Closure part 7 has a grip 10 which is, as illustrated, in the shape of an enlarged, reinforcing rib.

Closure body 7 is preferably formed from an extrudable, slightly resilient plastic, and is manufactured in a process separate from the remainder of the container. The closure body is connected in a pivotable fashion after the insertion of its trunions 8 in bearing cups 5 in the top 2 of bottle 1, and is held tightly thereon. The closure body occupies the position shown in FIG. 1 when a breakable closure 3 is mounted on the top 2, and after the breakable closure has been removed, the closure element is pivoted into the position shown in FIG. 3 in which the discharge opening of the bottle, which is preferably also somewhat resilient, is closed and is held in its rest position. To open the discharge opening, the closure body is simply pivoted back into the position shown in FIG. 1 in which body 7 can rest on an annular collar on the container top adjacent the container body.

Closure body 7 can alternatively be affixed on the bottle which has another form of closure, for example a threaded closure, insofar as the closure body 7 and the discharge opening mate with each other and bearing cups 5 for trunions 8 are present beneath the discharge opening.

The closure body can also be configured as a 1-sided, U-shaped or stirrup-shaped element which can be mounted on a bottle, wherein one arm includes the closure part and the other arm is provided with a single trunion such that in a relaxed condition the trunions are held in the bearing cups.

While one advantageous embodiment has been chosen to illustrate the invention, it will be understood by those skilled in the art that various changes and modifications can be made therein without departing from the scope of the invention as defined in the appended claims.

What is claimed is:

1. A plastic container of the type having a blow-molded container body and a container top with a breakable member removable to open a discharge opening formed therein, comprising means on said container top defining an annular discharge cup surrounding said discharge opening and having an annular rim;

means on said container top defining a blind recess extending inwardly from the outer surface thereof, said recess being spaced from said discharge opening; and a closure member for selectively closing the discharge opening, said closure member including a generally U-shaped body having at one end a bearing member receivable and rotatable in said recess, and a closure portion spaced from said bearing member and shaped to engage the rim of said discharge cup and close said discharge opening.

2. A container according to claim 1 wherein said container top includes means defining blind recesses at diametrically opposite sides thereof, and wherein said body of said closure member has bearing members at opposite ends thereof, each said bearing member comprising an inwardly extending trunion shaped to enter one of said recesses.

3. A container according to claim 2 wherein said closure portion is a generally spherical projection.

4. A container according to claim 3 wherein said discharge opening and said closure member are both spherical.

5. A reclosable blow-molded plastic container having a body and a top comprising means formed on the top of said container defining a breakable closure attached to said container top by a portion of reduced diameter so that breaking off of said closure forms a discharge opening in said top;

means in said top defining an annular recess surrounding said discharge opening; and a closure member for selectively closing said discharge opening, said closure member including a generally U-shaped body, bearing means near opposite ends of said U-shaped body for pivotally supporting said U-shaped body on said top, and a projection intermediate said ends for engaging said annular recess.

6. A container according to claim 5 and including an annular collar on said container top adjacent said container body for supporting said closure member when it is in other than its closed position.

* * * * *